US005847311A

United States Patent [19]

Ryder

[11] Patent Number: 5,847,311

[45] **Date of Patent: *Dec. 8, 1998**

[54] HYBRID INFLATOR WITH CRYSTALLINE AND AMORPHOUS BLOCK COPOLYMER

[75] Inventor: David D. Ryder, Gilbert, Ariz.

[73] Assignee: TRW Vehicle Safety Systems Inc., Lyndhurst, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 734,596

[22] Filed: Oct. 22, 1996

[51] Int. Cl.[6] ..... C06B 45/12

[52] U.S. Cl. ..... 102/288; 102/289; 149/19.4; 149/19.5

[58] Field of Search ..... 102/286, 289; 149/19.4, 19.5

[56] References Cited

U.S. PATENT DOCUMENTS

| | | | |
|---|---|---|---|
| 3,723,205 | 3/1973 | Scheffee | 149/19 |
| 3,793,099 | 2/1974 | Duerksen et al. | 149/19 |
| 4,812,180 | 3/1989 | Sayles | 149/19.5 |
| 4,919,737 | 4/1990 | Biddle et al. | 149/19.5 |
| 5,009,728 | 4/1991 | Chan et al. | 149/19.1 |
| 5,210,153 | 5/1993 | Manser et al. | 525/410 |
| 5,368,662 | 11/1994 | Willer et al. | 149/19.9 |
| 5,411,290 | 5/1995 | Chan et al. | 280/737 |
| 5,458,706 | 10/1995 | Finck et al. | 149/19.2 |
| 5,486,248 | 1/1996 | Taylor et al. | 149/109.6 |
| 5,525,171 | 6/1996 | Finck et al. | 149/19.6 |
| 5,540,794 | 7/1996 | Willer et al. | 149/19.8 |
| 5,583,315 | 12/1996 | Fleming | 149/19.4 |
| 5,641,938 | 6/1997 | Holland et al. | 149/48 |

OTHER PUBLICATIONS

ICT Conference 1990 Publication "Technology of Polymer Compounds and Energetic Materials".

*Primary Examiner*—Peter A. Nelson
*Attorney, Agent, or Firm*—Tarolli, Sundheim, Covell, Tummino & Szabo

[57] ABSTRACT

A hybrid inflator for an inflatable vehicle occupant protection device comprises a quantity of a stored inflation fluid (42) and a body (44) of an ignitable combustible material to heat the stored inflation fluid and increase its pressure. The body (44) of ignitable combustible material comprises a solid binder and an oxidizing agent. The binder is a block copolymer comprising blocks of an amorphous polymeric monomer in an alternating sequence with blocks of a crystalline polymeric monomer. A preferred block copolymer comprises a long chain polyether glycol as the amorphous polymeric monomer and a polybutylene terephthalate as the crystalline polymeric monomer.

19 Claims, 2 Drawing Sheets

HYBRID INFLATOR WITH CRYSTALLINE AND AMORPHOUS BLOCK COPOLYMER

FIELD OF THE INVENTION

The present invention relates to an apparatus for inflating a vehicle occupant protection device, such as an air bag. The present invention is particularly applicable to a hybrid inflator, and to a combustible material used to heat a stored inflation fluid within the hybrid inflator.

BACKGROUND OF THE INVENTION

A hybrid inflator for inflating a vehicle occupant protection device includes a quantity of a stored inflation fluid and a body of a combustible material to heat the inflation fluid. A common inflation fluid is one which at least predominantly is an inert gas. An igniter is actuatable to ignite the body of combustible material. As the body of combustible material burns, combustion products heat the stored inflation fluid. This increases the pressure of the inflation fluid.

U.S. Pat. No. 3,723,205 discloses a hybrid inflator in which the combustible material comprises a plasticized polyvinylchloride fuel binder, a plasticizer such as dioctyl adipate for the binder, an inorganic oxidizer salt dispersed in the binder such as ammonium perchlorate, and an alkali metal salt chlorine scavenger such as potassium nitrate.

U.S. Pat. No. 5,411,290 discloses a hybrid inflator in which the combustible material comprises polytetrafluoroethylene as an oxidizing polymeric film and an oxidizable material such magnesium, aluminum, titanium, and zirconium.

U.S. Pat. No. 5,486,248 discloses a hybrid inflator in which the combustible material comprises a thermosetting hydroxy terminated polybutadiene resin which is liquid at room temperature and functions as a binder when cured, an isocyanate curing agent, a plasticizer such as an adipate, and an inorganic oxidizer. The thermosetting resin is extrudable, but affords little flexibility in the extrusion process and equipment which can be used.

SUMMARY OF THE INVENTION

The present invention relates to a hybrid inflator for inflating a vehicle occupant protection device. The hybrid inflator comprises a quantity of a stored inflation fluid. The hybrid inflator also comprises a body of an ignitable combustible material to heat the stored inflation fluid and increase its pressure. The body of ignitable combustible material comprises a solid organic polymeric binder which is combustible, and one or more oxidizing agents for supporting combustion of the solid organic polymeric binder. The solid organic polymeric binder comprises a thermoplastic block copolymer comprising blocks of an amorphous polymeric monomer in an alternating sequence with blocks of a crystalline polymeric monomer. A preferred amorphous polymeric monomer of the block copolymer is a long chain polyether glycol and a preferred crystalline polymeric monomer is a polybutylene terephthalate. Preferably, the block copolymer consists essentially of about 25 to about 55 wt. % amorphous polymeric monomer and about 75 to about 45 wt. % crystalline polymeric monomer.

Preferably, the block copolymer contains oxygen atoms, and more preferably has an oxygen content of at least about 20 wt. %.

Preferably, the block copolymer is plasticized. A preferred plasticizer also contains oxygen atoms. A preferred plasticizer is a citrate.

BRIEF DESCRIPTION OF THE DRAWINGS

Further features of the present invention will become apparent to those skilled in the art to which the present invention relates from reading the following specification with referee to the accompanying drawings, in which.

DESCRIPTION OF PREFERRED EMBODIMENT

General Description

Figure 1:
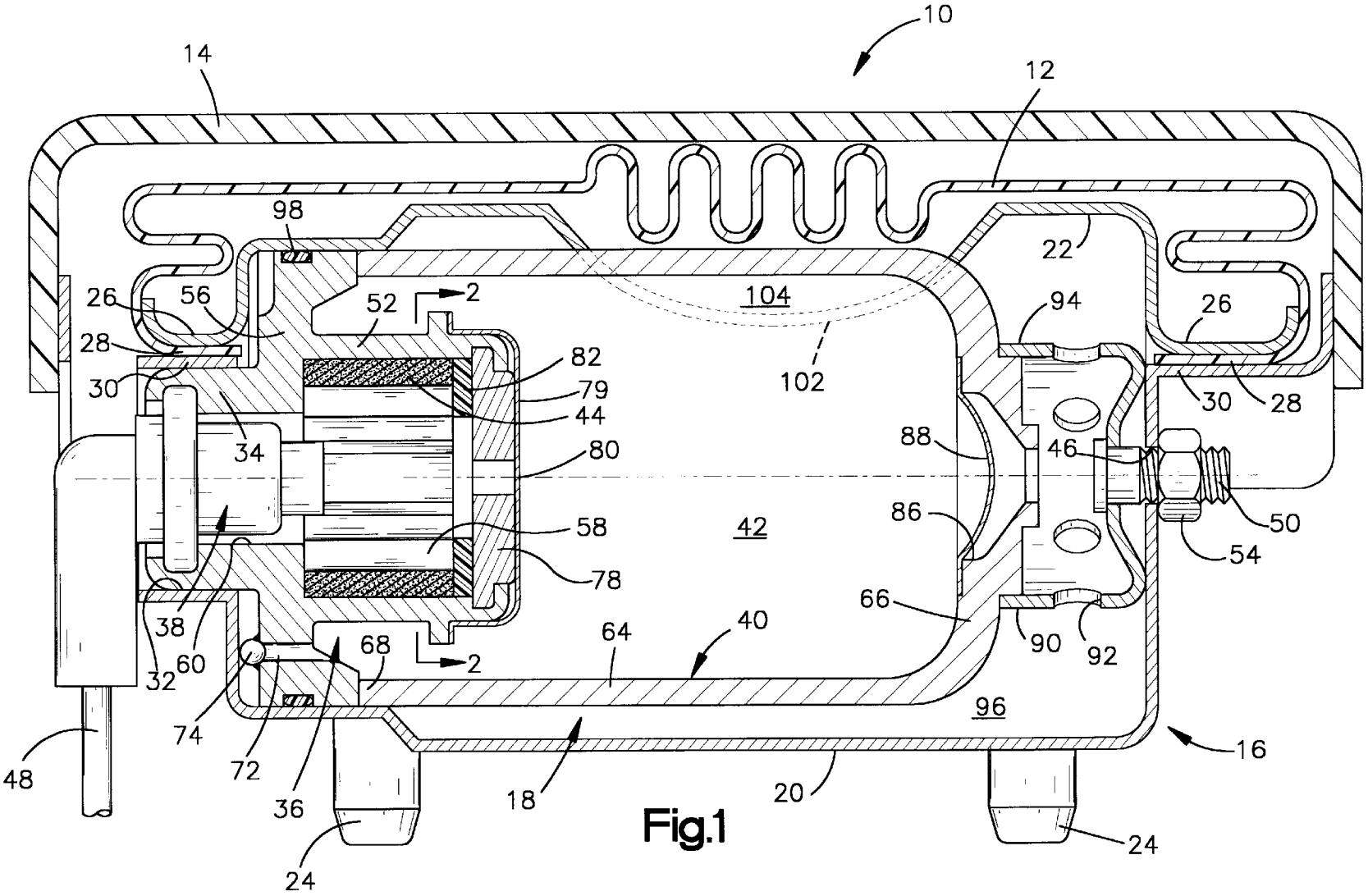
FIG. 1 is a schematic sectional view of an apparatus embodying the present invention.

An apparatus 10, shown schematically in FIG. 1, includes a particular type of an inflatable vehicle occupant protection device 12 which is commonly referred to as an air bag. In FIG. 1, the air bag 12 is in a stored, uninflated, folded condition within a cover 14 of the apparatus 10. The air bag 12 is inflatable from the stored condition shown in FIG. 1 to an inflated condition in which the air bag 12 extends into the occupant compartment (not shown) of a vehicle to help protect an occupant of the vehicle from a forceful impact with parts of the vehicle. An outer portion (not shown) of the cover 14 defines a deployment opening through which the air bag 12 deploys when the air bag 12 is being inflated.

The air bag 12 is part of an air bag module 16 which is mounted in the vehicle. In addition to the air bag 12, the air bag module 16 includes an inflator 18, an inflator mounting plate 20, and an inflator and bag retainer 22. The inflator mounting plate 20 is mounted in the vehicle by connections 24. The inflator and bag retainer 22 comprises an annular flange 26 which extends around the periphery of the retainer 22. The mounting plate 20 also comprises an annular flange 30 which extends around the periphery of the mounting plate 20. The flange 26 of the inflator and bag retainer 22 and the flange 30 of the mounting plate 22 clamp between them the edge 28 of the air bag 12. This holds the air bag 12 in place as shown at the right and left hand sides of the drawing of FIG. 1.

On the left hand side of the drawing of FIG. 1, the mounting plate 20 comprises a circular opening 32. The inflator 18 comprises an axially extending hub 34 which extends into the opening 32. On the right hand side of the drawing of FIG. 1, the mounting plate 20 comprises a second opening 46. The inflator 18 comprises an axially extending threaded stud 50 which extends into the opening 46. A nut 54 is screwed onto the stud 50 and, along with the plate surface that defines the opening 32, holds the inflator 18 in position within the mounting plate 20.

The inflator 18 comprises a combustion chamber housing 36, an actuator assembly 38, and a pressure vessel 40. The pressure vessel 40 contains a stored quantity of an inflation fluid 42 which is under pressure. The combustion chamber housing 36 contains a body 44 of a combustible material.

The actuator assembly 38 of the inflator 18 is mounted within a passageway 60 of the hub 34. The actuator assembly comprises an electrical circuit which includes an electrical connection 48. The electrical connection 48 is connected with a power source (not shown), which may be the vehicle battery and/or a capacitor, through a normally open switch. The switch is part of a sensor which senses a condition indicating the occurrence of a vehicle collision. The collision-indicating condition may comprise, for example, a sudden vehicle deceleration. If the collision-indicating condition is above a predetermined threshold, for which inflation of the air bag 12 is desired to help protect an occupant of the vehicle, the sensor then closes the switch, actuating the actuator assembly 38.

The combustion chamber housing 36 is a generally cylindrical member which comprises a cylindrical wall section 52. The cylindrical wall section 52 is formed in one piece with and coaxial with the hub 34 of the inflator 18. The combustion chamber housing 36 also comprises an annular radially directed flange 56 which extends outwardly from the junction of the cylindrical wall section 52 and the hub 34. Thus, the wall section 52 and hub 34 extend axially in opposite directions from the flange 56.

The cylindrical wall section 52 of the combustion chamber housing 36 defines a combustion chamber 58 and contains the body 44 of a combustible material. The body 44 of combustible material is generally cylindrical and is centered coaxially within the combustion chamber 58. The passageway 60 of the hub 34 is coaxial with and communicates with the combustion chamber 58. Thus, the body 44 of combustible material is exposed to the actuator assembly 38.

The pressure vessel 40 comprises a cylindrical side wall 64, a domed end 66 at one end of the side wall 64, and an end 68 which is opposite the domed end 66. The end 68 is secured, for example by welding, to the flange 56 of the combustion chamber housing 36. Thus, the cylindrical wall section 52 of the combustion chamber housing 36 extends axially into the pressure vessel 40.

The flange 56 of the combustion chamber housing 36 includes a fill-hole 72. During assembly of the apparatus 10, the stored inflation fluid 42 is introduced into the pressure vessel 40 by means of the fill-hole 72. After introduction of the inflation fluid 42, the fill-hole 72 is closed by ball 74, which is welded in place.

The right end, as viewed in FIG. 1, of the cylindrical wall section 52 of the combustion chamber housing 36 has a strainer 78 crimped onto the wall section 52. A cap 79 covers the strainer 78 and closes the combustion chamber 58. The cap 79 has a scored area 80 which allows the cap 79 to rupture when the body 44 of combustible material burns and the combustion chamber 58 reaches a predetermined pressure. A resilient shock absorbing compressible ring 82 seats between the strainer 78 and the body 44 of combustible material so as to hold the body 44 of combustible material and prevent its movement axially within the combustion chamber 58.

The domed end 66 of the pressure vessel 14 comprises an opening 86 which is closed by a burst disk 88. A diffuser 90 is mounted on the outside of the domed end 66, for example by welding. The threaded stud 50 connects with the diffuser 90. The diffuser 90 is generally cylindrical with spaced apart openings 92 in the side wall 94 of the diffuser.

The inflator and bag retainer 22 and the inflator mounting plate 20 in combination define a manifold area 96 around the pressure vessel 40 and diffuser 90. The manifold area 96 is sealed, at its left end as viewed in FIG. 1, by annular ring seal 98 in the combustion chamber housing flange 56. The manifold area 96 is in fluid communication with the diffuser 90 by means of the openings 92 in the diffuser 90.

When the sensor, above-mentioned, senses the occurrence of a collision-indicating condition, a switch closes, allowing current to pass to a conventional squib (not shown) in the actuator assembly 38. This ignites a pyrotechnic charge (also not shown) within the squib. The pyrotechnic charge, by way of example, may comprise about 72% boron potassium nitrate ($BKNO_3$), about 14% titanium hydride, and about 14% potassium perchlorate.

The pyrotechnic charge, when ignited, spews burning particles into the combustion chamber 58 of the combustion chamber housing 36, igniting the body 44 of combustible material. The burning of the body 44 of combustible material causes a rupture of the cap 79, spewing hot combustion products into the pressure vessel 40.

The hot combustion products heat the stored inflation fluid 42 in the pressure vessel 40, increasing the pressure of the inflation fluid 42. When the pressure in the pressure vessel 40 reaches a predetermined pressure, it causes the burst disk 88 to rupture. Upon rupturing the burst disk 88, the stored and heated inflation fluid 42 and the combustion products from the combustion of the body 44 of combustible material flow from the pressure vessel 40 into the diffuser 90 and through the diffuser openings 92 into the manifold area 96.

The inflator retainer 22 comprises an edge 102, shown in dashed lines in FIG. 1. The edge 102 is spaced from wall 64 of the pressure vessel 40 and defines with the pressure vessel wall 64 an opening 104. The fluid escapes rapidly from the manifold area 96 through the opening 104 into the air bag 12. This inflates the air bag 12 rapidly outwardly into the vehicle occupant compartment.

Body of Combustible Material

Figure 2:
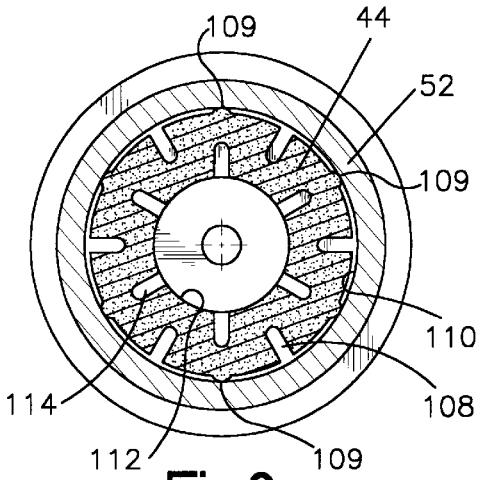
FIG. 2 is a sectional view of a part of FIG. 1 taken along line 2—2 of FIG. 1.
Figure 2A:
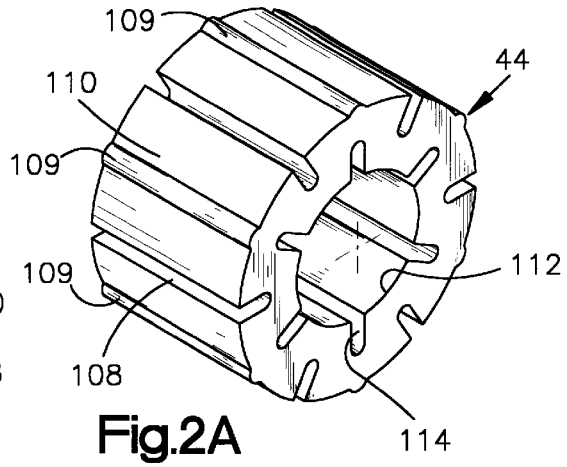
FIG. 2A is a perspective view of a body of combustible material shown in of FIG. 2.

The body 44 of combustible material has a generally cylindrical cross sectional configuration, as can be seen in FIGS. 2 and 2A. The body 44 comprises an array of equally spaced apart, longitudinally extending and radially directed outer slots 108 on the outside surface 110 of the body. Between the slots 108, the body 44 has a plurality of spaced apart longitudinally extending ridges 109. An axial opening 112 extends longitudinally through the center of the body. The body 44 has an array of equally spaced apart, longitudinally extending and radially directed inner slots 114 which intersect the opening 112. The inner slots 114 are positioned, circumferentially, about half way between the outer slots 108. The configuration of the body 44 of combustible material preferably is obtained by molding or extruding the material of which the body 44 is made.

The configuration of FIGS. 2 and 2A is useful in the ignition and combustion of the body 44 of combustible material. The axial opening 112, and the outer and inner slots 108 and 114 provide open spaces in the combustion chamber 58 which allow burning pyrotechnic material from the actuator assembly 38 to penetrate deeply into the combustion chamber 58 and increase the rate of ignition of the body 44 of combustible material. The opening 112 and slots 108 and 114 also increase the rate of combustion of the body 44 of combustible material, allowing the combustion to progress radially and circumferentially as well as axially. The ridges 109 space the outside surface 110 from the wall section 52 of the combustion chamber housing 36 providing additional open area for ignition of the body 44 of combustible material.

The body 44 of combustible material comprises a solid organic polymeric binder which is combustible and one or more inorganic particulate oxidizing agents. The solid organic polymeric binder functions as a fuel component in the body 44 of combustible material and the inorganic particulate oxidizing agents furnish oxygen for the combustion of the solid organic polymeric binder. In addition, the solid organic polymeric binder functions as a solid binder material for the inorganic particulate oxidizing agents and other ingredients in the body 44 of combustible material.

The solid organic polymeric binder of the present invention is a thermoplastic block copolymer which consists essentially of segments of a crystalline polymeric monomer in an alternating sequence with segments of an amorphorous polymeric monomer. The thermoplastic block copolymer is prepared by repetitive alternating additions of the crystalline monomer and the amorphous monomer onto the active end of the polymer chain.

A function of the amorphous polymeric monomer in the block copolymer of the present invention is to provide good extrudability or moldability characteristics to the body 44 of combustible material. The body 44 of combustible material should be extrudable or moldable at a temperature which is well below the decomposition temperature of other ingredients in the body 44. For instance, one preferred inorganic particulate oxidizing agent in the body 44 of combustible material is ammonium perchlorate. This compound degrades at about 270° C. The body 44 of combustible material should be extrudable or moldable, using conventional extrusion or molding equipment, at a temperature well below 270° C., preferably below about 170° C.

In addition, the amorphous polymeric monomer functions to make the body 44 of combustible material non-brittle and prevent shattering of the body 44 of combustible material, from shock, vibration, or ignition, at very low temperatures. An accepted temperature range through which the body 44 of combustible material should be operative extends from a high of about 85° C. to a low of about −40° C.

A major factor in the extrudability of the body 44 of combustible material at a temperature less than about 170°, and resistance to shattering at a temperature as low as −40° C., is the melting point of the block copolymer in the body 44. Preferably, the block copolymer of the present invention has an effective amount of amorphous monomer to provide a block copolymer melting point in the range of about 100° C. to about 160° C. Good results have been obtained using a block copolymer having a melting point less than about 130° C., specifically about 106° C.

A function of the crystalline monomer in the block copolymer of the present invention is to maintain the shape of the body 44 of combustible material for the expected life of the inflator. The inflator has to be designed for repeated exposures to temperatures as high as about 85° C. The body 44 of combustible material has to retain its shape for its expected life, e.g., 10 years, despite such exposure. A measure of the crystallinity in the block copolymer of the present invention is the hardness of the block copolymer. Preferably, the block copolymer has a Durometer D hardness greater than about 30.

Another measure of the crystallinity is a simulated aging test in which the body 44 of combustible material is held at an elevated temperature for a period of time and then measured for slump or deformation. In the present invention, the simulated aging test that was used was to hold samples at temperatures starting at 95° C. and increasing to 120° C., in 5° increments, for one hour at each temperature.

Preferably, the block copolymer of the present invention contains a relatively high wt. % of oxygen atoms. A preferred oxygen content is greater than about 20 wt. %, more preferably in the range of about 20 wt. % to about 35 wt. %. A high oxygen content in the block copolymer facilitates combustion of the block copolymer and the conversion of monoxides to dioxides. Preferably, the remainder of the block copolymer, after subtracting the oxygen content, consists essentially of atoms of carbon and atoms of hydrogen.

A preferred amorphorous monomer of the block copolymer is a polymer based on a long chain polyether glycol, such as polyethylene glycol or polypropylene glycol. A preferred crystalline monomer of the block copolymer is a polybutylene terephthalate. This polymer is the polyester resin reaction product of terephthalic acid and polybutylene and remains crystalline at temperatures at least as high as 85° C. Block copolymers of a polyether glycol and a polybutylene terephthalate are marketed by E.I. duPont de Nemours & Co. under the trademark HYTREL. A variety of grades of Hytrel are available which differ primarily in the compositions of the amorphous monomer and crystalline monomer and in the ratio of amorphous monomer to crystalline monomer.

Broadly, the block copolymer of the present invention comprises about 10 to about 90 wt. % amorphous polyether monomer and about 90 to about 10 wt. % crystalline polyester monomer. Preferably, the block copolymer of the present invention consists essentially of about 45 to about 75 wt. % amorphous polyether monomer and about 55 to about 25 wt. % crystalline polyester monomer.

The following Table 1 gives data for representative grades of Hytrel polyester/polyether block copolymers useful in the present invention.

TABLE 1

| Property | HYTREL 8184 | HYTREL 4056 | HYTREL 3548 | HYTREL 8171 |
|---|---|---|---|---|
| Durometer D Hardness | 31.2 | 40 | 35 | 32 |
| Melting point | 106.6° C. | 150° C. | 155° C. | 150° C. |
| Oxygen Content | 31.8% | 25% | 22% | 30% |

All of the polyester/polyether block copolymers of Table 1 have average molecular weights of about 50,000 to 60,000, and about 25 to about 55 wt. % crystalline polyester monomer and about 75 to about 45 wt. % amorphous polyether monomer. All are thermoplastic and are readily extrudable or moldable using conventional extrusion or molding equipment, at temperatures lower than about 170° C.

In addition to the polyester/polyether block copolymer, the body 44 of combustible material preferably comprises a plasticizer for the block copolymer and one or more inorganic oxidizing agents. The body 44 of pyrotechnic material may also comprise such ingredients as a burn rate enhancer, one or more coolants, strengthening fibers, and other ingredients common in the art.

One advantage of the polyester/polyether block copolymers of the present invention is that they are compatible with a large number of plasticizers. The body 44 of combustible material of the present invention can comprise up to 75 parts by weight of plasticizer per hundred parts by weight of block copolymer.

Preferably, the plasticizer also has a high oxygen content. A preferred plasticizer for use in the body 44 of combustible material of the present invention is a citrate such as triethyl citrate, acetyl triethyl citrate or tri-n-butyl citrate, marketed under the trademark "CITROFLEX" by Morflex, Inc. All are non-energetic in the body 44 of combustible material of the present invention.

It is also possible to use a low molecular weight energetic plasticizer from the glycidyl azide polymer family that is capped with an azide or nitrate group, for instance a glycidyl azide polymer (GAP) plasticizer marketed by 3M Company under the trade designation "3M GAP L12616".

A mixture of plasticizers can also be used, for instance GAP with a citrate. The use of one or more plasticizers permits further adjustment of mechanical properties, performance of the combustible material, the oxygen content in the body of combustible material and types of gases evolved during combustion of the combustible material.

The oxidizing agent in the body 44 of combustible material of the present invention preferably is a mixed oxidizer system in which one of the oxidizers preferably is potassium perchlorate ($KClO_4$) and the oxidizer system comprises at least one secondary oxidizer which is either ammonium perchlorate ($NH_4ClO_4$) or ammonium nitrate ($NH_4NO_3$), or a combination of ammonium perchlorate and ammonium nitrate. A preferred mixed oxidizer system of the present invention comprises, based on the weight of the body 44 of combustible material, about 20 to about 50 wt. % potassium perchlorate and about 15 to about 60 wt. % of a secondary oxidizer. Preferably, the potassium perchlorate and secondary oxidizer are ground to or have a particle size of about 5 to about 30 microns.

The body 44 of combustible material of the present invention preferably also comprises a coolant such as potassium carbonate or an oxamide, such as ethane diamide, or a derivative of an oxamide such as tetramethyl oxamide or dimethyl oxamide. The body 44 of combustible material of the present invention may also contain a burn rate enhancer such as copper chromite or iron oxide ($Fe_2O_3$), and other additives known in the art.

The following Table 2 provides preferred ratios, on a weight basis for the body 44 of combustible material:

TABLE 2

| | |
|---|---|
| Block Copolymer | 15 to 40 wt. % |
| Plasticizer | 5 to 30 wt. % |
| Inorganic oxidizer | 65 to 80 wt. % |
| Burn rate enhancer | 0 to 3 wt. % |
| Coolant | 0 to 15 wt. % |

The following Table 3 gives representative Examples of combustible materials useful in the present invention.

TABLE 3

| | |
|---|---|
| Composition 1 | |
| Binder (15% HYTREL 8184 and 15% Citroflex) | 130 wt % |
| Potassium perchlorate | 20 wt % |
| Secondary oxidizer (25% ammonium nitrate and 25% ammonium perchlorate) | 50 wt % |
| Composition 2 | |
| Binder (15% HYTREL 8184 and 15% Citroflex) | 30 wt % |
| Potassium perchlorate | 25 wt % |
| Secondary oxidizer (20% ammonium perchlorate and 15% ammonium nitrate) | 35 wt % |
| Coolant (potassium bicarbonate) | 10 wt % |
| Composition 3 (NPH-005) | |
| Binder (10% HYTREL 4056 and 15% Citroflex) | 25 wt % |
| Potassium perchlorate | 48 wt % |
| Secondary oxidizer (14.5% ammonium nitrate and 12% ammonium perchlorate) | 26.5 wt % |
| Burn rate enhancer ($Fe_2O_3$) | 0.5 wt % |
| Composition 4 (NPH-3548) | |
| Binder (9.2% HYTREL 3548 and 13.8% Citroflex) | 23 wt % |

TABLE 3-continued

| | |
|---|---|
| Potassium perchlorate | 50 wt % |
| Secondary oxidizer (14.5% ammonium nitrate and 12% ammonium perchlorate) | 26.5 wt % |
| Burnrate enhancer ($Fe_2O_3$) | 0.5 wt % |
| Composition 5 (PAP-003) | |
| Binder (15% HYTREL 8171 and 15% Citroflex) | 30 wt % |
| Potassium perchlorate | 41 wt % |
| Secondary oxidizer (ammonium perchlorate) | 27.5 wt % |
| Burn rate enhancer ($Fe_2O_3$) | 1.5 wt % |
| Composition 6 (PAP-002) | |
| Binder (13.5% HYTREL 8171 and 13.5% Citroflex) | 27 wt % |
| Potassium perchlorate | 45 wt % |
| Secondary oxidizer (ammonium perchlorate) | 24.5 wt % |
| Coolant (oxamide) | 2 wt % |
| Burn rate enhancer ($Fe_2O_3$) | 1.5 wt % |

Stored Inflation Fluid

The stored inflation fluid 42 is preferably stored in the pressure vessel 40 at a pressure of approximately 500 to about 5,000 psi, preferably about 3,000 psi to about 4,500 psi. The stored inflation fluid 42 is, at least predominantly, an inert gas, but preferably contains an amount of an oxidizer gas, up to 25 volume percent. A preferred oxidizer gas is oxygen. A preferred inert gas is argon. Other inert gases which can be used include helium and nitrogen, and mixtures of argon, helium, and nitrogen. The stored gas can also be air. Air consists, on a weight basis, of the inert gases nitrogen and argon, in the amounts of about 75.5% and 1.3% respectively, and oxygen, in the amount of about 23.2%. Also, a mixture of air and an inert gas such as argon can be used.

Normally, unless the stored inflation fluid 42 is air alone, the amount of oxygen in the stored inflation fluid is preferably in the range of about 5 volume percent to about 20 volume percent. The weight ratio of the body 44 of combustible material to stored inflation fluid 42, in the inflator 18, is preferably in the range from about 1:10 to about 1:5. Typically, the amount of stored inflation fluid may be about 40–55 grams and the body 44 of combustible material may be about 5–8 grams.

EXAMPLES 1 AND 2

Samples of combustible material having the compositions given in the following Table 4 were prepared:

TABLE 4

| Component | Example 1 (PAP-012) | Example 2 (PAP-003) |
|---|---|---|
| Hytrel 8184 | 17 wt % | |
| Hytrel 8171 | | 15 wt % |
| Plasticizer | 7.5 wt % triethyl citrate | 15 wt % acetyl triethyl citrate |
| $KClO_4$ | 25 wt % | 41 wt % |
| $NH_4ClO_4$ | 25 wt % | 27.5 wt % |
| $NH_4NO_3$ | 25 wt % | |
| Burn rate catalyst | 0.5 wt % copper chromite | 1.5 wt % iron oxide |
| Total wt % | 100% | 100% |

The samples were prepared by batch mixing the ingredients in a Baker Perkins Vertical Sigma Blade mixer. This is a jacketed batch mixer capable of mixing ingredients at an elevated temperature. The mixing was performed at about 140° C. The polymer and plasticizer were first added to the mixer and mixed, and then the solid inorganic ingredients were added.

Following mixing, the mixture was allowed to cool with continued agitation to provide a granulated product. This product was then molded into hollow cylindrical bodies having generally the configuration of FIG. 2. This was accomplished in a heated cylindrical mold by pouring the granules into the mold. The mold had a center pin around which the granules flowed. When the granules reached molding temperature, they were compacted with a hydraulic ram. Following compacting, the ram was withdrawn, and then the center pin, and the hollow cylindrical body was removed and cut to desired lengths. The following Table 5 gives molding data for the samples.

TABLE 5

| Example | Molding Temperature | Molding Pressure |
|---|---|---|
| EX 1 (PAP-012) | 100–105° C. | 1,000 psi |
| EX 2 (PAP-003) | 140° C. | 1,000 psi |

Table 5 shows that the samples of Example 1 were moldable at a lower temperature than the samples of Example 2. As shown in Table 4, the polymer of Example 1 was Hytrel 8184 grade, and the polymer of Example 2 was Hytrel 8171 grade. As shown in Table 1, Hytrel 8184 grade had a melting point of 106.6° C. and Hytrel 8171 grade had a melting point of 150° C.

Following molding, the slots 108 and 114 (FIG. 2) were cut into the samples. In an extrusion process, the slots would be die formed during extrusion.

The samples were subjected to an aging test to determine the ability of the samples to hold their shape at an elevated temperature for a prolonged period of time. Specifically, the samples were placed in an oven and held in the oven for one hour at successively higher temperatures ranging, in increments of 5° C., from 95° C. to 120° C.

All of the samples tested exhibited good resistance to slump.

The samples of Examples 1 and 2 were fired in a test inflator having the configuration of FIG. 1. The inflator contained an inflation fluid comprising, on a volume basis, 20% oxygen and 80% of a mixture of 95% argon and 5% helium.

The following Table 6 gives amounts of combustible material used and amounts of stored inflation fluid used.

TABLE 6

| | EX 1 (PAP-012) | EX 2 (PAP-003) |
|---|---|---|
| Weight of body of combustible material | 6 grams | 8 grams |
| Weight of stored inflation fluid | 43 grams | 40 grams |

Figure 3:
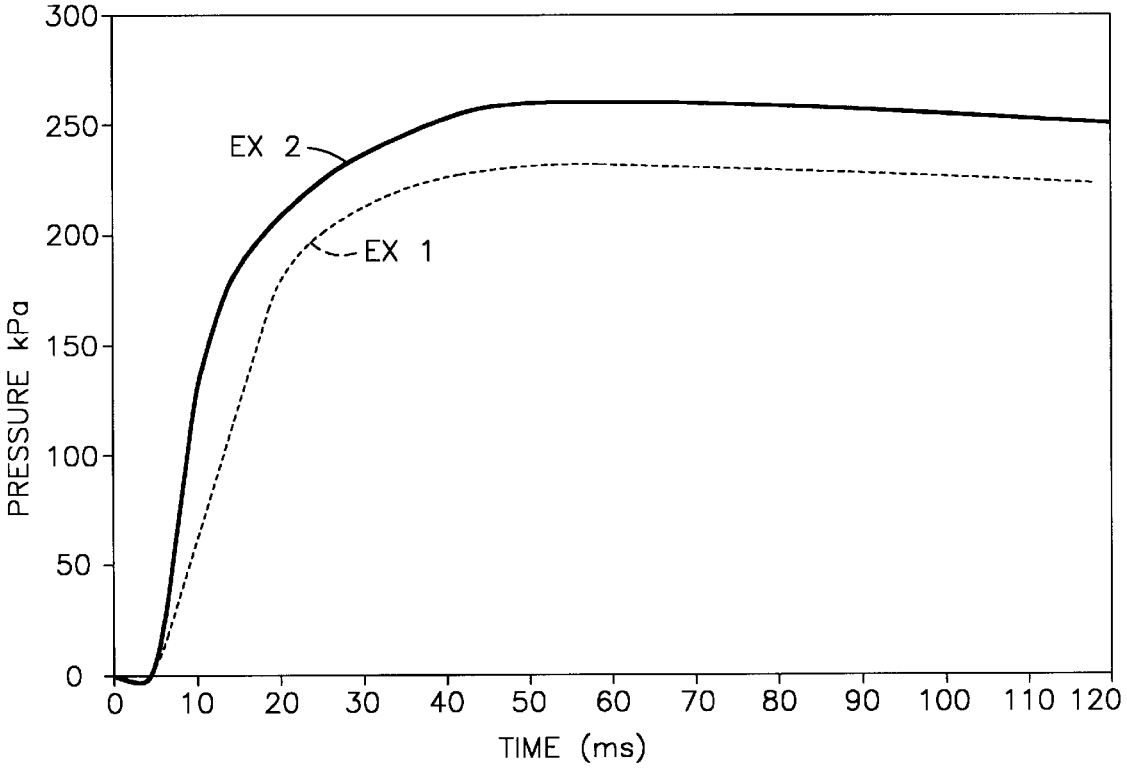
FIG. 3 is a graph showing the rate of increase in inflator pressure resulting from combustion of samples of combustible materials contained within the device of FIG. 1.

The firings produced the tank pressure curves shown in FIG. 3. The following Table 7 summarizes the firing results:

TABLE 7

| Measurement | EX 1 | EX 2 |
|---|---|---|
| Peak Tank Pressure | 229 | 260 |
| Seconds to Peak Tank Pressure | 59 | 62.9 |
| Slope of the Curve at 10 ms. (KPa/ms) | 13 | 19.9 |

FIG. 3 and Table 7 show that the burn rate characteristics for Example 1 were very similar to those for Example 2. The burn rate characteristics of both Examples 1 and 2 were acceptable.

The combustion products were primarily water vapor, carbon dioxide and some carbon monoxide. Trace amounts of nitrogen compounds such as nitrogen oxides were formed. Small amounts of particulate were produced. The following Table 8 summarizes the results:

TABLE 8

| Example | $CO_2$ (ppm) | CO (ppm) | Particulate (mg) |
|---|---|---|---|
| EX 1 | 16,688 | 342 | 635 |
| EX 2 | 27,535 | 4,188 | 1,275 |

In Table 8, the smaller amounts of $CO_2$, CO, and particulates for Example 1, compared to Example 2, are due to the smaller amount of combustible material used (see Table 6). However, whether for 6 grams or 8 grams of combustible material, the amounts of CO and particulates are relatively low, compared to the use of a polyvinylchloride binder.

Typically the combustion of a polyvinylchloride containing composition produces about three times as much particulate as indicated above.

Examples 1 and 2 illustrate an advantage of the present invention. The burn rate characteristics of the body of combustible material in an inflator for a vehicle occupant protection device are of critical importance. The similarity in burn rate characteristics between Example 1 and Example 2 was primarily because the polymer in Example 1, in terms of carbon, hydrogen, and oxygen content, was essentially the same as that of Example 2. However, the samples of Example 1 were extrudable or moldable at much lower temperatures than those of Example 2. This shows the ability, using a block copolymer having both amorphous and crystalline components as the binder in a body of combustible material, to select a type of polymer which gives the desired burn rate characteristics, and then achieve different specific property values, such as extrusion or molding temperature, using a specific grade of the polymer.

From the above description of the invention, those skilled in the art will perceive improvements, changes and modifications. Such improvements, changes and modifications within the skill of the art are intended to be covered by the appended claims.

Having described the invention, the following is claimed:

1. A hybrid inflator for a vehicle occupant protection device comprising:

(a) a stored inflation fluid;

(b) a body of an ignitable combustible material in an effective amount which, when ignited, provides hot combustion products to heat the stored inflation fluid and increase its pressure;

said body of ignitable combustible material comprising a solid organic polymeric binder and an oxidizing agent, said solid organic polymeric binder comprising a thermoplastic block copolymer comprising at least one amorphous polymeric block and at least one crystalline polymeric block wherein said amorphous polymeric block is a long chain polyether glycol and said crystalline polymeric block is polybutylene terephthalate.

2. The inflator of claim 1 wherein said block copolymer consists essentially of about 25 wt. % to about 55 wt. % crystalline polyester monomer and about 75 wt. % to about 45 wt. % amorphous polyether monomer.

3. The inflator of claim 2 wherein said block copolymer contains oxygen atoms in the amount of at least about 20 wt. %.

4. The inflator of claim 3 wherein said block copolymer has a melting point less than about 160° C. and a Durometer D hardness more than about 30.

5. The inflator of claim 4 wherein said block copolymer has a melting point less than about 130° C.

6. The inflator of claim 5 wherein said body of ignitable combustible material is extrudable or moldable at a temperature less than about 170° C.

7. The inflator of claim 6 wherein said binder comprises a plasticizer for said block copolymer and said plasticizer contains oxygen atoms.

8. The inflator of claim 7 wherein said solid organic polymeric body of ignitable combustible material comprises about 15 wt. % to about 40 wt. % thermoplastic block copolymer, about 5 wt. % to about 30 wt. % plasticizer, and about 65 wt. % to about 80 wt. % inorganic oxidizing agent.

9. The inflator of claim 8 wherein said plasticizer is a citrate and said inorganic oxidizing agent consists essentially of $KClO_4$ and a secondary oxidizer selected from the group consisting of $NH_4ClO_4$, $NH_4NO_3$, and mixtures thereof.

10. The inflator of claim 9 wherein the weight ratio of stored inflation fluid to body of ignitable combustible material is about 5:1 to about 10:1.

11. The inflator of claim 1 wherein said block copolymer contains oxygen atoms in the amount of at least about 20 wt. % and said body of ignitable combustible material comprises a plasticizer which is triethyl citrate, acetyl triethyl citrate or a tri-n-butyl citrate.

12. A hybrid inflator for a vehicle occupant protection device comprising:

(a) a stored inflation fluid;

(b) a body of an ignitable combustible material in an effective amount which, when ignited, provides hot combustion products to heat the stored inflation fluid and increase its pressure;

said body of ignitable combustible material comprising
Solid Organic Polymeric Binder 15 to 40 wt. %
oxygenated plasticizer 5 to 30 wt. %
Potassium perchlorate 20 to 5 wt. %
Ammonium perchlorate and/or ammonium nitrate 15 to 60 wt. %
wherein said solid organic polymeric binder is a thermoplastic block copolymer comprising at least one amorphous polymeric block and at least one crystalline polymeric block and contains oxygen atoms in the amount of at least about 20 wt. %.

13. The inflator of claim 12 wherein said stored inflation fluid comprises less than 25% by volume oxygen and an inert gas selected from the group consisting of argon, helium and nitrogen.

14. A hybrid inflator for a vehicle occupant protection device comprising:

(a) a stored inflation fluid;

(b) a body of an ignitable combustible material in an effective amount which, when ignited, provides hot combustion products to heat the stored inflation fluid and increase its pressure;

said body of ignitable combustible material having an extruded or molded configuration and comprising a combustible solid organic polymeric fuel binder and an inorganic oxidizing agent, said solid organic polymeric fuel binder comprising a thermoplastic block copolymer of at least one amorphous block in an effective amount whereby the block copolymer has a melting point in the range of 100° C. to 130° C., and at least one crystalline block in an effective amount whereby the block copolymer has a Durometer D hardness greater than about 30, said block copolymer containing oxygen atoms in the amount of at least 20 wt. %.

15. The inflator of claim 14 wherein said amorphous block is present in an effective amount to impart non-brittleness to said body at −40° C. and said crystalline block imparts slump resistance to said body and is present in an effective amount to resist slump when the body of combustible ignitable material is subjected to a simulated aging test in which said body is held at temperatures starting at 95° C. increasing to 120° C. in 5° C. increments, for one hour at each temperature.

16. The inflator of claim 15 wherein said body of ignitable combustible material comprises about 15 wt. % to about 40 wt. % thermoplastic block copolymer, about 5 wt. % to about 30 wt. % plasticizer, and about 65 wt. % to about 80 wt. % inorganic oxidizing agent.

17. A hybrid inflator for a vehicle occupant protection device comprising:

(a) a stored inflation fluid;

(b) a body of an ignitable combustible material in an effective amount which, when ignited, provides hot combustion products to heat the stored inflation fluid and increase its pressure;

said body of ignitable combustible material having an extruded or molded configuration and comprising a combustible solid organic polymeric fuel binder and an inorganic oxidizing agent, said solid organic polymeric fuel binder comprising a thermoplastic block copolymer of at least one amorphous block and at least one crystalline block wherein said amorphous block is present in an effective amount to facilitate extrudability or moldability of the body of ignitable combustible material at a temperature in the range of 100° C. to 130° C. and to impart non-brittleness to said body at −40° C. and said crystalline block is present in an effective amount to resist slump when the body of combustible ignitable material is subjected to a simulated aging test in which said body is held at temperatures starting at 95° C. increasing to 120° C., in 5° C. increments, for one hour at each temperature;

said block copolymer containing oxygen atoms in the amount of at least 20 wt. %.

18. The inflator of claim 17 wherein said amorphous block is present in an effective amount whereby the block copolymer has a melting point in the range of 100° C. to 130° C. and the crystalline block is present in an effective amount whereby the block copolymer has a Durometer D hardness greater than about 30.

19. The inflator of claim 18 wherein said body of ignitable combustible material comprises about 15 wt. % to about 40 wt. % thermoplastic block copolymer, about 5 wt. % to about 30 wt. % plasticizer, and about 65 wt. % to about 80 wt. % inorganic oxidizing agent.

* * * * *

UNITED STATES PATENT AND TRADEMARK OFFICE

CERTIFICATE OF CORRECTION

PATENT NO : 5,847,311

DATED : December 8, 1998

INVENTOR(S) : David D. Ryder

It is certified that error appears in the above-identified patent and that said Letters Patent is hereby corrected as shown below:

Col. 11, line 41
replace "5"
with --50--.

Signed and Sealed this

First Day of June, 1999

*Attest:*

Q. TODD DICKINSON

*Attesting Officer*

*Acting Commissioner of Patents and Trademarks*